US005107955A

United States Patent [19]

Kishi

[11] Patent Number: 5,107,955

[45] Date of Patent: Apr. 28, 1992

[54] OPERATION CONTROL MECHANISM OF LIFTING APPARATUS

[75] Inventor: Mitsuhiro Kishi, Tochigi, Japan

[73] Assignee: Japanic Corporation, Tochigi, Japan

[21] Appl. No.: 704,339

[22] Filed: May 23, 1991

[51] Int. Cl.[5] ..... B66F 11/04

[52] U.S. Cl. ..... 182/2; 182/14; 182/63

[58] Field of Search ..... 182/2, 12, 13, 14, 19, 182/63, 148

[56] References Cited

U.S. PATENT DOCUMENTS

| | | | |
|---|---|---|---|
| 4,160,492 | 7/1979 | Johnston | 182/2 |
| 4,331,215 | 5/1982 | Grove | 182/14 |
| 4,558,758 | 12/1985 | Littman | 182/2 |
| 4,759,685 | 7/1988 | Souda | 182/2 |
| 4,899,097 | 2/1990 | Chapman | 182/2 |
| 5,021,917 | 6/1991 | Pike | 182/2 |

*Primary Examiner*—Reinaldo P. Machado
*Attorney, Agent, or Firm*—Flynn, Thiel, Boutell & Tanis

[57] ABSTRACT

A lifting apparatus including a chassis having front and rear ends, and a drive unit for moving the chassis in forward or rearward directions. A turntable is mounted on the chassis for horizontal turning movement between front and rear positions. Boom assembly is mounted on the turntable and has a bucket mounted adjacent the free end thereof. An operating mechanism including an operator-actuated driving member is mounted on the bucket for controlling the forward and rearward traveling direction of the chassis. The driving member is movable in opposite first and second directions relative to the boom assembly for respectively causing forward and rearward travel of the chassis when the turntable is in the front position. A reversing arrangement reverses the controlling direction of the driving member when the turntable is in the rear position so that movement of the driving member in the first and second directions relative to the boom assembly respectively causes backward and forward travel of the chassis.

10 Claims, 13 Drawing Sheets

OPERATION CONTROL MECHANISM OF LIFTING APPARATUS

BACKGROUND OF THE INVENTION

1. Field of the Invention

The present invention relates to a lifting apparatus for use, for example, in constructing buildings, repairing highways, painting and the like at elevated locations in order to load operators or materials on a bucket attached thereto, and particularly to an operation control mechanism of the lifting apparatus capable of controlling the drive of a chassis of the lifting apparatus forward or backward in the same direction as the bucket is directed irrespective of the positional relationship between a turntable and the chassis.

2. Prior Art

There has been employed a lifting apparatus capable of raising or lowering an elevator or a bucket for assembling, painting and repairing at elevated locations such as a highway or building construction, wherein the operator or the material is loaded on or unloaded from the bucket or the elevator.

The lifting apparatus of this type is classified as a boom-type, scissors-type, X-type and the like. It is common to any type of such lifting apparatus that a control apparatus is installed in the bucket for controlling a chassis of the lifting apparatus. The operator on the bucket operates the control apparatus provided inside the bucket so that the lifting apparatus can perform various operations whereby the bucket can be raised to the height required for the working.

There have been employed in many cases a lever-type or joystick type mechanism in which the lever is pushed or pulled for turning on or off the switch so that a three-directional valve is switched for supplying oil under pressure. The three-directional valve is controlled to control the supply of oil under pressure to each part of the lifting apparatus and the adjustment of the amount of oil under pressure.

The lifting apparatus of this kind has an advantage that scaffolds can be omitted which enhances the convenient workability but a disadvantage that the operator is liable to involve unexpected accident at the time of operating the lifting apparatus.

Particularly, in the typically used boom-type lifiting apparatus, the turntable mounted on the chassis can be turned horizontally 360° relative to the chassis. In view of such mechanism, the operator is liable to be involved in an accident at the time of driving the chassis forward or backward.

For instance, if the turntable is directed forward relative to the chassis, the chassis can move forward by pushing a lever forward. However, the lever to be pushed in forward direction or pulled in backward direction can be controlled with keeping the relation between the chassis and the turntable or the bucket but without any relation between the pushing or pulling direction of the lever and the direction of the turntable or the bucket. That is, the direction where the driving lever pushed or pulled is not at all related with the chassis direction where the turntable or the bucket is turned. Accordingly, when the chassis is traveled forward or backward while the turntable is turned 180° relative to the chassis, i.e. in the rearward direction of the chassis and hence opposite to the normal forward direction, the operator feels a reverse driving feeling, i.e. as if he drove the chassis backward. That is, if the lever is pushed, i.e. in the forward direction of the bucket, the chassis travels forward while the turntable is directed to the rear side of the chassis. That is, the operator feels as if he drove the chassis backward. Accordingly, the operator must operate in a feeling reversed to the ordinary driving feeling.

Furthermore, in such a case, i.e. at the state where the turntable is turned 180°, an accident is more liable to occur. For example, if a beam or other building approaches the back of the operator in this case, a collision or the like is liable to occur which can be very dangerous. That is, there is a case that the operator pushes the lever forward for driving the turntable and the chassis forward in the normal driving mode in the direction of the boom. However, if the turntable on the chassis is turned backward relative to the chassis, then the chassis travels forward (i.e., opposite the direction of the boom). As a result, there may occur an accident in that the operator may be caught in the space between the bucket and a beam or building.

To minimize the chance of an accident resulting in injury or death, it is preferable to indicate the position of the turntable relative to the chassis on an indication panel of the control apparatus. However, the operator frequently overlooks the indication on the panel during the operation and realizes the mistake of the operation only when involved in an accident.

Although the structure having the turntable capable of turning through a full horizontal rotation relative to the chassis is very convenient in working operations such as repairing and painting at elevated locations, it is very dangerous to drive the chassis forward while the turntable is directed to the rear of the chassis since the operator feels as if he is driving the chassis backward.

SUMMARY OF THE INVENTION

It is an object of a first aspect of the present invention to provide an operation control mechanism of a lifting apparatus capable of directing the drive control lever in a direction toward the travelling direction of the chassis at all times. As a result, the operator's driving feeling is always constant irrespective of the direction of the turntable relative to the chassis. Consequently, accidents resulting in injury or death caused by the reverse driving feeling of the operator can be prevented beforehand.

It is an object of a second aspect of the present invention to provide an operation control mechanism capable of turning the operating means in the horizontal direction, and turning the operating means so as to compensate for the turning angle detected by an detector disposed between the chassis and the turntable. With this mechanism, the chassis travel direction and the operating lever movement direction are always kept in parallel with one another.

To achieve the first object of the present invention, the lifting apparatus comprises a movable chassis, a turntable capable of horizontally turning relative to the chassis, a lifting mechanism mounted on the turntable and capable of vertically telescopically moving relative to the chassis, a bucket connected to the upper or free end portion of the lifting mechanism capable of loading an operator thereon and being raised to a higher position by the lifting mechanism, an operating means including lever means provided in the bucket for travelling the chassis in forward or backward directions, a detecting means for detecting the relative position between the chassis and the turntable, a reversing means for reversing the controlling direction of the lever means and the operating means whereby the chassis moves in the direction where the operating means is pushed even if the turntable is positioned anywhere relative to the chassis.

To achieve the second object of the present invention, the lifting apparatus comprises a movable chassis, a turntable capable of horizontally turning relative to the chassis, a lifting mechanism mounted on the turntable and capable of vertically telescopically moving relative to the chassis, a bucket connected to the upper or free end portion of the lifting mechanism capable of loading an operator thereon and being raised to a maximum height by the lifting mechanism, an operating means for travelling the chassis in forward or backward directions, a detecting means for detecting the relative position between the chassis and the turntable, a rotary keeping means for turning the operating means horizontally relative to the control mechanism, and a correcting means for driving the rotary keeping means upon reception of a signal detected by the detecting means so as to compensate and keep the operating means parallel with the chassis travel direction.

DETAILED DESCRIPTION

First Embodiment (FIGS. 1 to 7)

Figure 1:
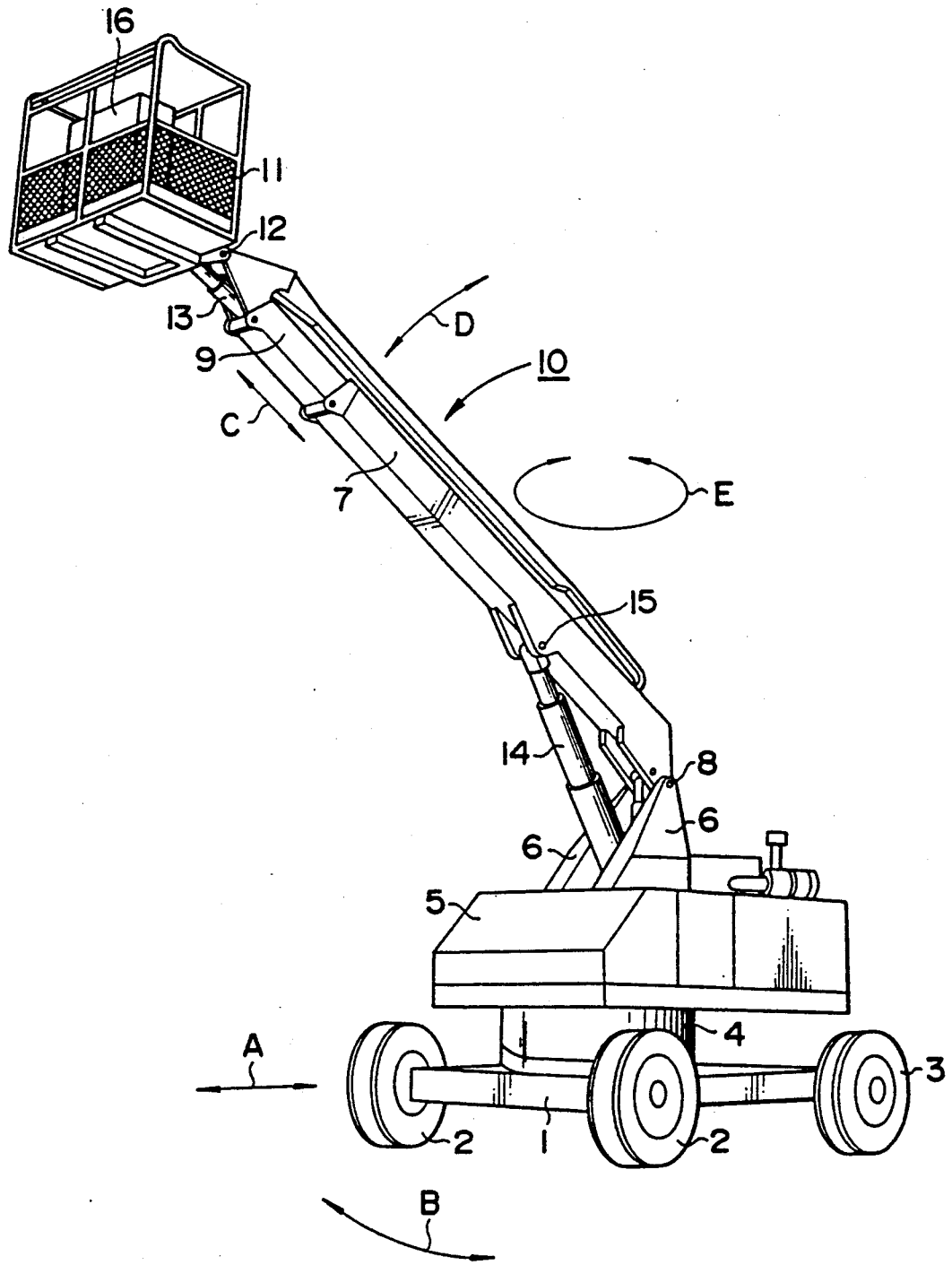
FIG. 1 is a perspective view showing a lifting apparatus employing an operation control mechanism according to a first embodiment of the present invention.

An operation control mechanism of a lifting apparatus according to a first embodiment of the present invention will be described with reference to FIGS. 1 to 7.

The lifting apparatus comprises a movable chassis 1 having front and rear wheels 2 and 3 supported on the chassis at the right and left sides thereof, a turning shaft (described later) protruding from the central upper surface of the chassis 1, a cylindrical skirt 4 for covering the turning shaft and a turntable 5 placed on the skirt 4 so as to horizontally turn through a full revolution and housing an engine and a generator for producing oil under pressure and the like.

The lifting apparatus further comprises a pair of triangular shaft supporting members 6 fixed to the upper surface of the turntable 5, a long lower boom 7 which is hollow at the inside thereof and square in cross section and pivotally mounted at the lower end thereof on the apexes of the triangles of the shaft supporting members 6 by a horizontal pivot pin 8, the lower boom 7 vertically swingable upward and downward about the pin 8, and a long upper boom 9 which is square in cross section and telescopically slidably inserted into an opening defined in the upper portion of the lower boom 7. A boom assembly 10, composed of the lower and upper booms 7 and 9, is telescopically stretchable in the longitudinal direction thereof by a hydraulic cylinder (not shown) provided therein. A square boxed type bucket 11 is connected to the tip end of the upper boom 9 by a pivot pin 12.

A correction hydraulic cylinder 13 is interposed between the upper boom 9 and the bucket 11 for correcting the posture of the bucket relative to the upper boom 9 so as to maintain the bucket horizontal. A hydraulic cylinder 14 is interposed between the turntable 5 and the lower boom 7 for inclining the lower boom 7 relative to the turntable 5. The lower boom 7 and the hydraulic cylinder 14 are connected with each other by a pivot pin 15.

The bucket 11 is formed of round pipes welded with each other and is of skeleton construction. A metal net covers the lower portion of the bucket 11 for preventing the operator or materials from falling therefrom. A cubic operation mechanism 16 is attached to the inside of the bucket 11 for operating the boom-type lifting apparatus.

Figure 2:
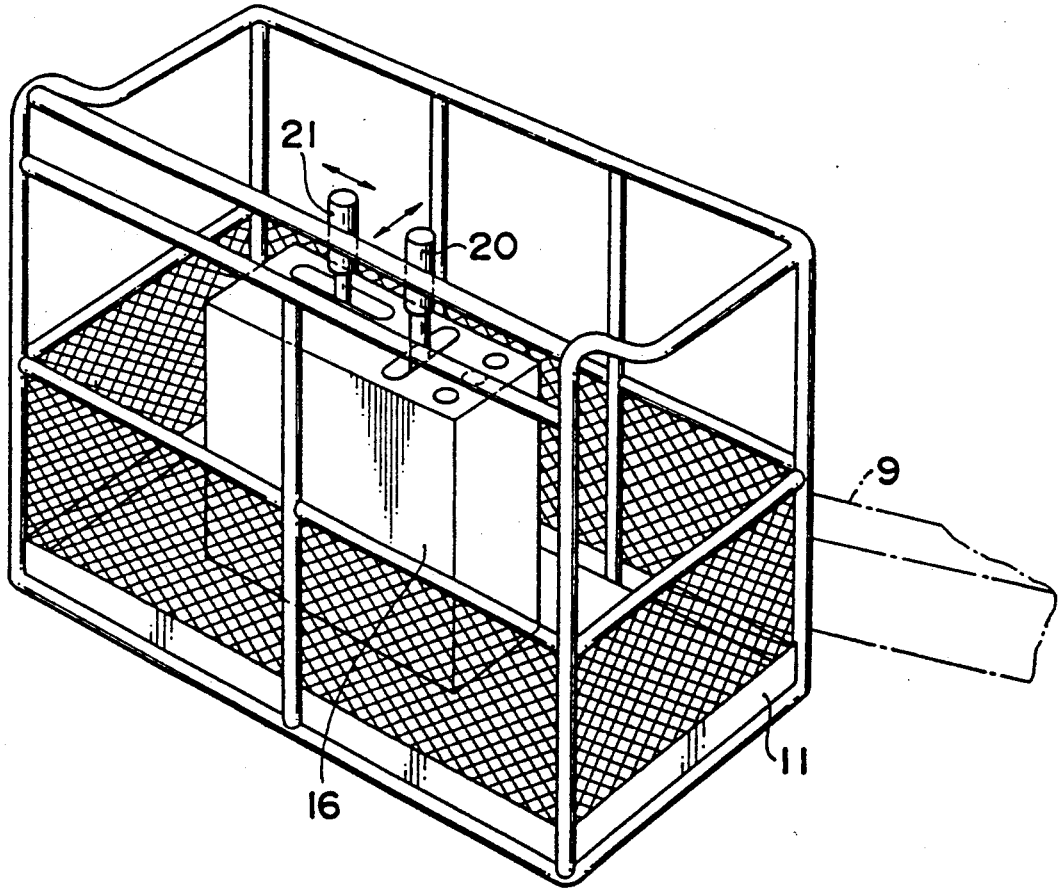
FIG. 2 is an enlarged perspective view showing a bucket and a portion adjacent to the bucket in FIG. 1.

The bucket 11 and the portion adjacent to the bucket 11 are illustrated in FIG. 2.

The bucket 11 is made of a combination of metal pipes and a steel plate and shaped like a bird cage. An upper portion of the bucket 11 is opened and a lower portion of the bucket 11 is formed of the steel plate for preventing the operator and the materials from falling therefrom. The cubic operation mechanism 16 is provided inside the bucket 11 and an electric circuit is incorporated in the operation mechanism 16 for controlling a fluid system and an electrical system.

Protruding from a top panel of the operation mechanism 16 is a driving lever 20 for controlling forward or backward travelling of the chassis 1 and a steering lever 21 for controlling rightward or leftward turning of the chassis 1. Other operation means, e.g. those for inclining or telescopically moving the boom assembly 10 are conventional and are omitted.

Figure 3:
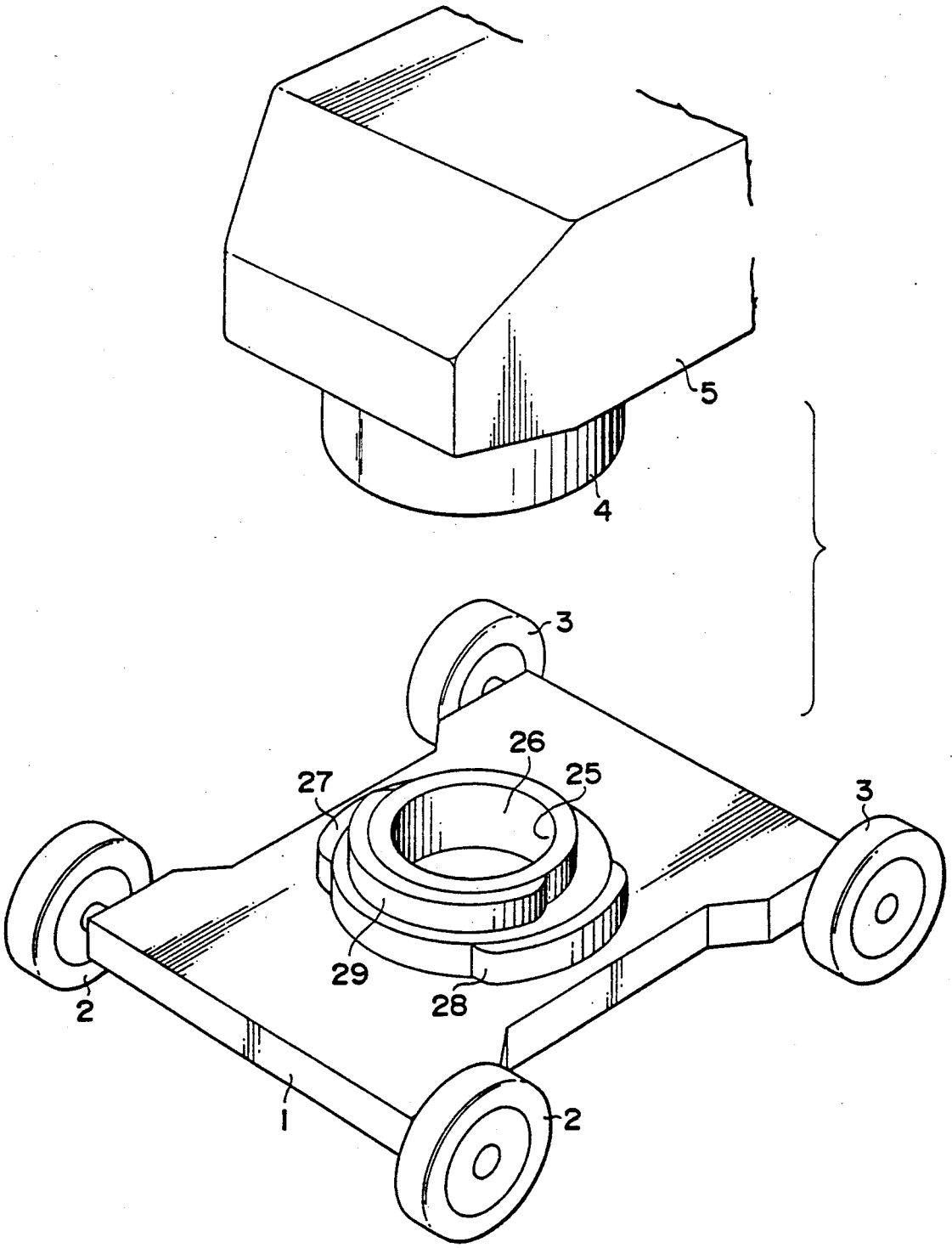
FIG. 3 is an enlarged pespective view showing a relationship between a chassis and a turntable, respectively constituents of the lifting apparatus in FIG. 1.

The turning shaft 25 protruding from the central portion of the chassis 1 will be illustrated in FIG. 3.

The protruding turning shaft 25 is ring shaped and has a shaft supporting hole 26 opening vertically at the central portion thereof, into which hole 26 a main shaft (not shown) attached to the lower surface of the turntable 5 is inserted by way of bearings and the like interposed between the shaft supporting hole 26 and the main shaft.

The turning shaft 25 has an outer diameter which is varied in two steps, i.e. an upper small diameter and a lower large diameter and the turning shaft 25 per se is not visible from the outside since it is covered by the skirt 4. Restricting cams 27 and 28 protrude from the lower portion of the turning shaft 25 viewed in right and left sides in FIG. 3 while a positioning cam 29 protrudes from the upper portion of the turning shaft 25 at the left side in FIG. 3.

Figure 4:
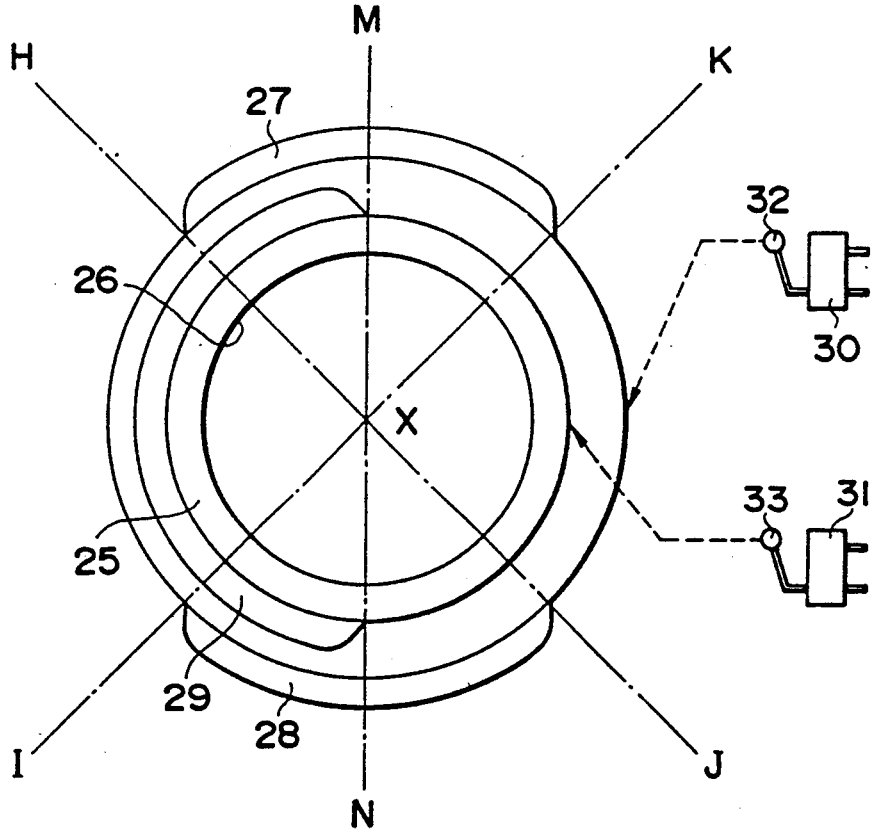
FIG. 4 is a plan view showing a positional relationship of cams of the lifting apparatus in FIG. 1.

A positional relation between the cams 27, 28 and 29 is described with reference to FIG. 4.

For convenience of explanation, the turning shaft 25 is divided by linear diametrical lines H-J and I-K which intersect central vertical axis X. The linear lines H-J and I-K are crossed at a right angle, i.e. 90°. The turning shaft 25 is further divided by a linear diametrical line M-N which also intersects axis X.

The angular interval between the linear lines H-J and M-N and between the linear lines I-K and M-N are respectively 45°. In such a divided space, the restricting cam 27 is disposed between the lines H and K, i.e. at the angular interval of 90° at the lower circumference of the turning shaft 25 while the restricting cam 28 is disposed between the lines I and J, i.e. at the angular interval of 90° at the lower circumference of the turning shaft 25. The positioning cam 29 disposed at the upper circumference of the turning shaft 25 is positioned between the lines M and N, i.e. at the angular interval of 180°. This means that the restricting cams 27 and 28 are disposed at the right and left of the turning shaft 25 in confronted relation while the positioning cam 29 is disposed in a semicircular shape between the restricting cams 27 and 28.

Contact points 32 and 33 of limit switches 30 and 31 contact the outer circumferences of the cams 27, 28 and 29 while the limit switches 30 and 31 are fixed to inner circumferences of the skirt 4 and turn together with the turntable 5. The contact point 32 of the limit switch 30 contacts the outer circumference of the restricting cams 27 and 28 provided at the lower step of the turning shaft 25 while the contact point 33 of the limit switch 31 contacts the outer circumference of the positioning cam 29 provided at the upper step of the turning shaft 25. Accordingly, when the turntable 5 turns relative to the chassis 1, the limit switches 30 and 31 are turned synchronously with the turn of the turntable 5 whereby the contact points 32 and 33 can detect the positions of the cams 27, 28 and 29 while they contact the outer circumferences of the restricting cams 27 and 28 and the circumference of the positioning cam 29.

The driving lever 20 will be described more in detail with reference to FIG. 5.

The driving lever 20 has a linear swing bar 35 connected to the lower portion thereof. The swing bar 35 has a shaft insertion hole 36 which penetrates the central portion thereof in the lateral direction and a supporting shaft 37 is inserted into the shaft insertion hole 36. The swing bar 35 and the driving lever 20 are swingable forward and backward (as shown by the arrow) by the supporting shaft 37. The swing bar has a flat spring seat 38 at the lower end thereof, which seat contacts coil springs 39 and 40 at the front and rear sides thereof so that the swing bar 35 is always kept upright in a centered or neutral position.

A square push member 41 is fixed to the swing bar 35 at a middle portion thereof between the handle 20 and the pivot 37 and is swingable together with the swing bar 35. Limit switches 42 and 43 having contacts 44 and 45 are positioned on opposite sides of the push member 41 so that the contact 44 and 45 are confronted with opposite sides of the push member 41.

When the driving lever 20 is pushed or pulled, the swing bar 35 and the push member 41 are interlocked with the driving lever 20 and likewise pushed or pulled so that the push member 41 contacts the contacts 44 or 45.

Figure 6:
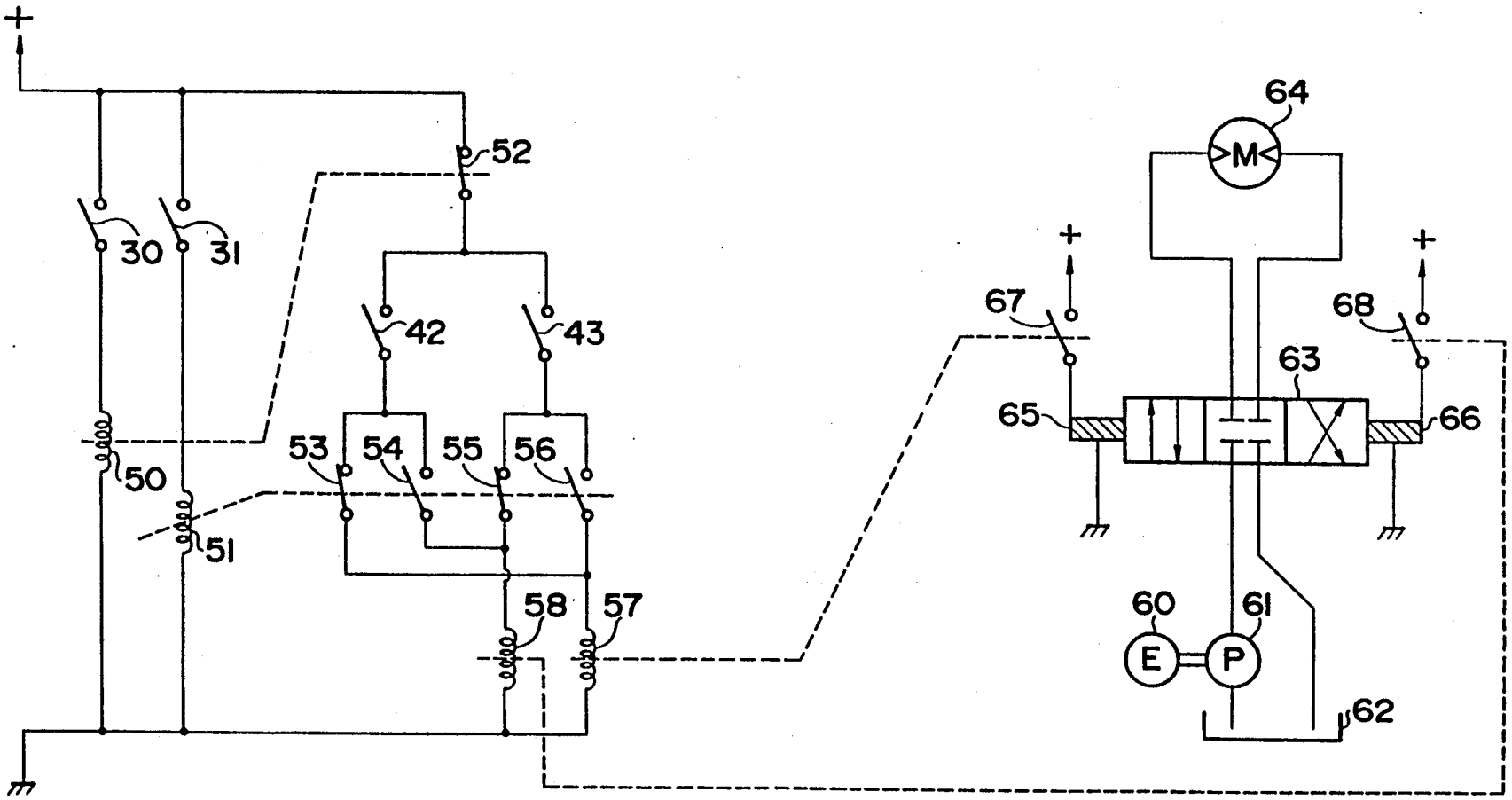
FIG. 6 is a block diagram showing an electric circuit and a hydraulic circuit employed in the apparatus in FIG. 1.

The circuit for controlling the chassis to travel forward or backward is described with reference to FIG. 6.

The limit switch 30 is connected in series to a relay 50 while the limit switch 31 is connected in series to a relay 51. A normally closed switch contact 52 is controlled by the relay 50 and connected in series with the parallel-arranged limit switches 42 and 43. The limit switch 42 is connected in series 1 with parallel-arranged normaly closed switch contact 53 and normally opened switch contact 54 which are controlled by the relay 51, while the limit switch 43 is connected in series with parallel-arranged normally closed switch contact 55 and normally opened switch contact 56 which are also controlled by the relay 51. The normally closed switch contact 53 and the normally opened switch contact 56 are connected with the relay 57, while the normally opened switch contact 54 and the normally closed switch contact 55 are connected with the relay 58.

A hydraulic circuit is described hereinafter with reference to FIG. 6.

A hydraulic pump 61 driven by an engine 60 has a suction side connected with an oil tank 62 for storing oil and a discharge side connected with a three-directional solenoid valve 63. The three-directional solenoid valve 63 is connected with a hydraulic motor 64 for driving the rear wheels 3. The solenoid valve 63 has selectively operated coils 65 and 66 in which the coil 65 is connected with a driving switch 67 controlled by the relay 57, and the coil 66 is connected with a driving switch 68 controlled by the relay 58.

An operation of the operation control mechanism according to the first embodiment of the present invention will be described hereinafter.

The engine 60 in the turntable 5 is actuated for driving the hydraulic pump 61 directly connected with the engine 60 whereby the hydraulic pump 61 generates oil under pressure. The oil under pressure is supplied to each part of the lifting apparatus. The lifting apparatus can move freely by the operation of the operation mechanism 16 installed inside the bucket 11.

That is, the operator located on the bucket 11 operates the operation mechanism 16 so that the chassis 1 travels forward or backward as illustrated in the direction of the arrow A (FIG. 1) and turns its direction rightward or leftward as illustrated in the direction of the arrow B. Furthermore, the upper boom 9 can be stretched or retracted as shown by arrows C by the telescopic movement of the boom assembly 10.

It is possible to move the bucket 11 to a higher position by outwardly telescopically moving the upper boom 9 in the direction of the arrow C with the stretchable motion of the boom body 10 and inclining the lower boom in the direction of the arrow D by telescopically moving the hydraulic cylinder 14.

It is also possible to turn the boom assembly 10 and bucket 11 horizontally in full rotation, i.e. 360° by rotating the turntable 5 in the the direction of the arrow E relative to the chassis 1. The operation of the lifting apparatus (i.e. boom mechanism 10) is the same as that of the conventional lifting apparatus and a known art.

Figure 7:
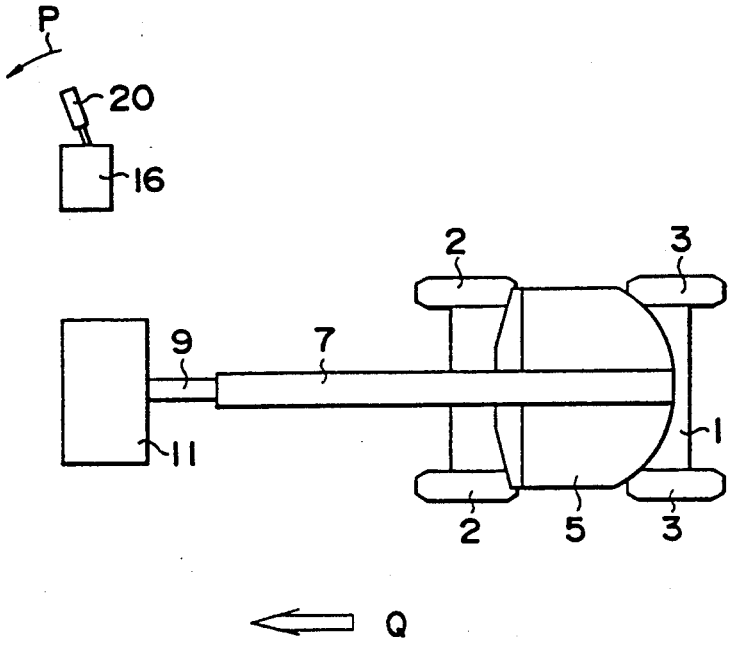
FIGS. 7(*a*) and 7(*b*) are views of assistance in explaining the operation of the lifting apparatus according to the first embodiment of the present invention.
Figure 7:
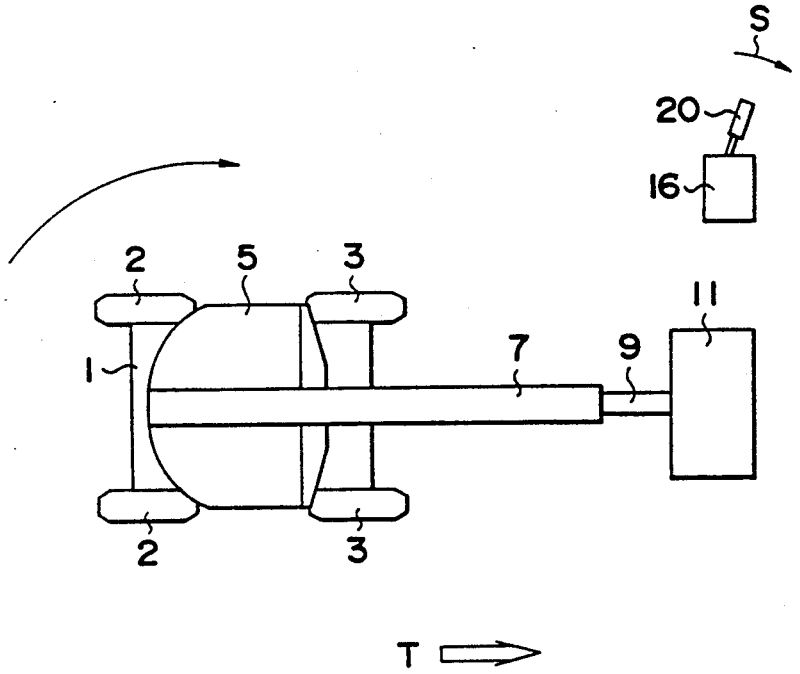
Figure 8:
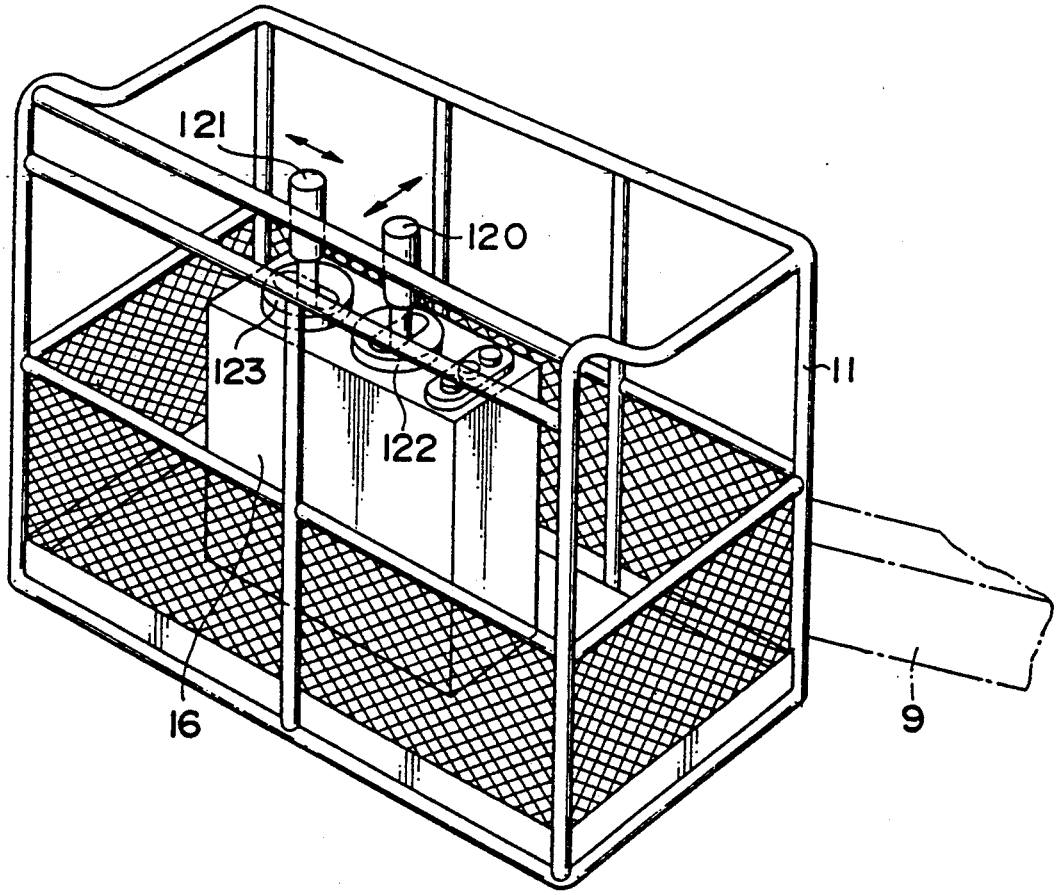
FIG. 8 is an enlarged perspective view showing a bucket and a portion adjacent to the bucket according to a second embodiment of the present invention.

There is descried a case of travelling the chassis 1 forward when the turntable 5 is turned so that the boom assembly 10 points in the forward direction as illustrated in FIG. 7(*a*).

Figure 5:
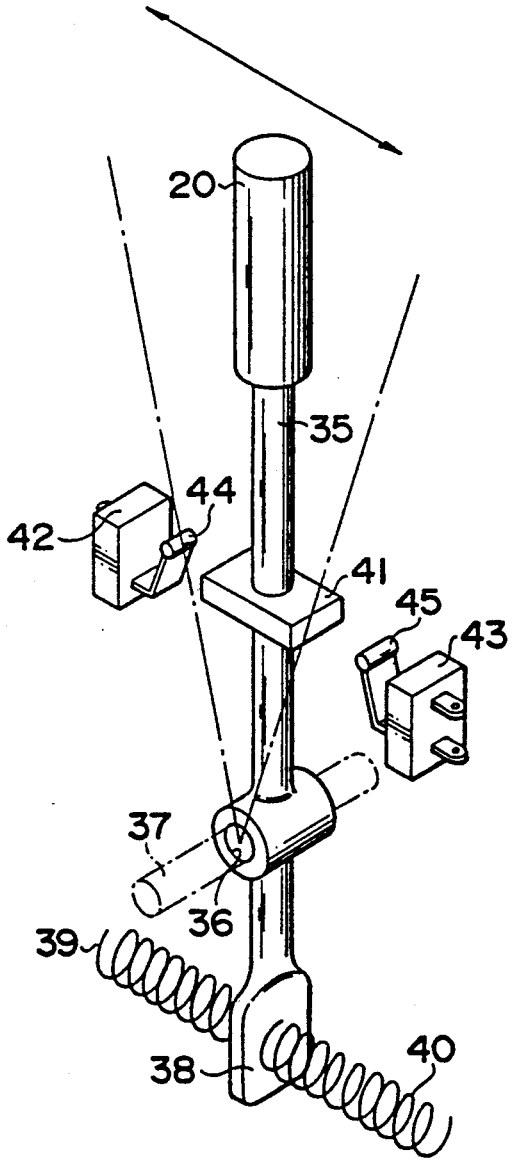
FIG. 5 is an exploded perspective view showing a control lever, a constituent of the lifting apparatus in FIG. 1.

When the operator pushes the driving lever 20 forward, i.e. in the direction of the arrow P in FIG. 7(*a*), the swing bar 35 in FIG. 5 is pushed forward about the supporting shaft 37 whereby the push member 41 contacts the contact 44, thereby rendering the limit switch 42 ON. As a result, a relay 57 is energized by way of the normally closed contact 52, the limit switch 42 and the normally closed contact 53, thereby rendering the driving switch 67 ON. When the driving switch 67 is turned on, the coil 65 is energized to thereby connect the solenoid valve 63 in the forward direction so that the hydraulic motor 64 is driven. Consequently, the rear wheels 3 rotates in the forward direction so that the chassis 1 travels in the direction of the arrow Q in FIG. 7(*a*). At this time, the limit switches 30 and 31 are positioned between the lines K and J in FIG. 4 and respectively turned off so that the relays 50 and 51 are not operated.

Subsequently, as the turntable 5 is turned horizontally relative to the chassis 1 the limit switches 30 and 31 are activated by the rotation of the turntable 5. When the turntable is positioned in the lateral direction of the chassis 1, i.e. between the lines K and H, and I and J, whereby the boom projects sidewardly of the chassis, the limit switch 30 is turned on and the relay 50 is operated so that the normally closed contact 52 is opened. As a result, the current does not flow toward the limit switches 42 and 43. In this state, even if the driving lever 20 is operated to close the limit switches 42 and 43, the chassis 1 can not travel forward or backward. This is made in the safety point of view, namely, when the turntable 5 is directed sideways, i.e. at an angle of about 45° to 90° relative to the travel direction of the chassis 1, whereby the chassis 1 can not travel in any direction.

There is next descried a case of travelling the chassis 1 forward when the turntable 5 is turned 180° relative to the chassis 1 so that the boom points rearwardly, as illustrated in FIG. 7(*b*), i.e. when the front portion of the turntable 5 is directed oppositely with the front portion of the chassis 1.

In this state, the contact 33 of the limit switch 31 contacts the positioning cam 29 so that the limit switch 31 is turned on and the relay 51 is operated. Accordingly, the normally closed contacts 53 and 55 are opened while the normally opened contacts 54 and 56 are closed so that the operation is reversed to the previous case. In this state, when the driving lever 20 is pushed in the direction of arrow S to travel the chassis 1 forward, the swing lever 35 and the push member 41 swing together with the driving lever 20 so that the push member 41 contacts the contact 44, thereby rendering the limit switch 42 ON. Accordingly, the relay 58 is energized by way of the normally closed contact 52, the limit switch 42 and the normally opened contact 54. As a result, the coil 66 is energized by way of the driving switch 68 which permits the solenoid valve 63 to be switched to the reverse direction.

Accordingly, the oil under pressure supplied from the hydraulic pump 61 is supplied to the hydraulic motor 64 in the reverse direction whereby the chassis 1 travels backward as illustrated in the arrow T in FIG. 7(*b*). Although the chassis 1 travels backward, the traveling direction of the chassis 1, i.e. the direction of the arrow T accords with the pushing direction of the lever, i.e. the direction of the arrow S. That is, the direction where driving lever 20 is pushed always accords with the traveling direction of the chassis 1 and the turning direction of the turntable 5. Hence, the operator's feeling for controlling the driving lever 20 always conforms to the traveling direction of the chassis 1 so that the operator's driving feeling is kept in the same direction.

In case that the driving lever 20 is operated to travel the chassis 1 backward, the direction where the chassis 1 and the turntable 5 are directed always accord with the traveling direction of the chassis, which does not give the operator malaise.

According to the first aspect of the present invention, the operator located on the bucket operates the operation mechanism to control the entire operation of the lifting apparatus. The chassis can be travelled forward or backward by the operation and turned right and left and the turntable can be turned horzontally relative to the chassis. The chassis travels forward if the driving lever is pushed forward in the case that the turntable is directed forward relative to the chassis 1. The chassis travels backward if the driving lever is pushed forward in the case that the boom is directed rearwardly with the turntable in the state where the turntable is turned 180° relative to the chasis. However, the operator always feels that the turntable, i.e. the chassis, travels in the direction where the driving lever 20 is pushed. Hence, it is possible to always accord the direction where the operator's view is directed with the direction where the driving lever 20 is pushed.

As evident from the description set forth above, although the operator considers the direction where the driving lever is pushed taking into account the direction where the turntable is directed, the travelling direction of the chassis is determined by pushing the driving lever in the direction where the turntable is directed, that is, the direction where the driving lever is pushed always accords with the direction where the chassis travels. Accordingly, the operator can always operate the lifting apparatus without feeling any malaise, which tends to prevent the operator from being involved in an accident resulting in injury or death.

Second Embodiment (FIG. 8 to 13)

The driving lever 120 is held by a rotary panel 122 which is disposed over an upper surface of the operation mechanism 16 and is rotatable horizontally, while the steering lever 121 is held by a rotary panel 123 which is disposed over the upper surface of the operation mechanism 16 and is rotatable horizontally.

Figure 9:
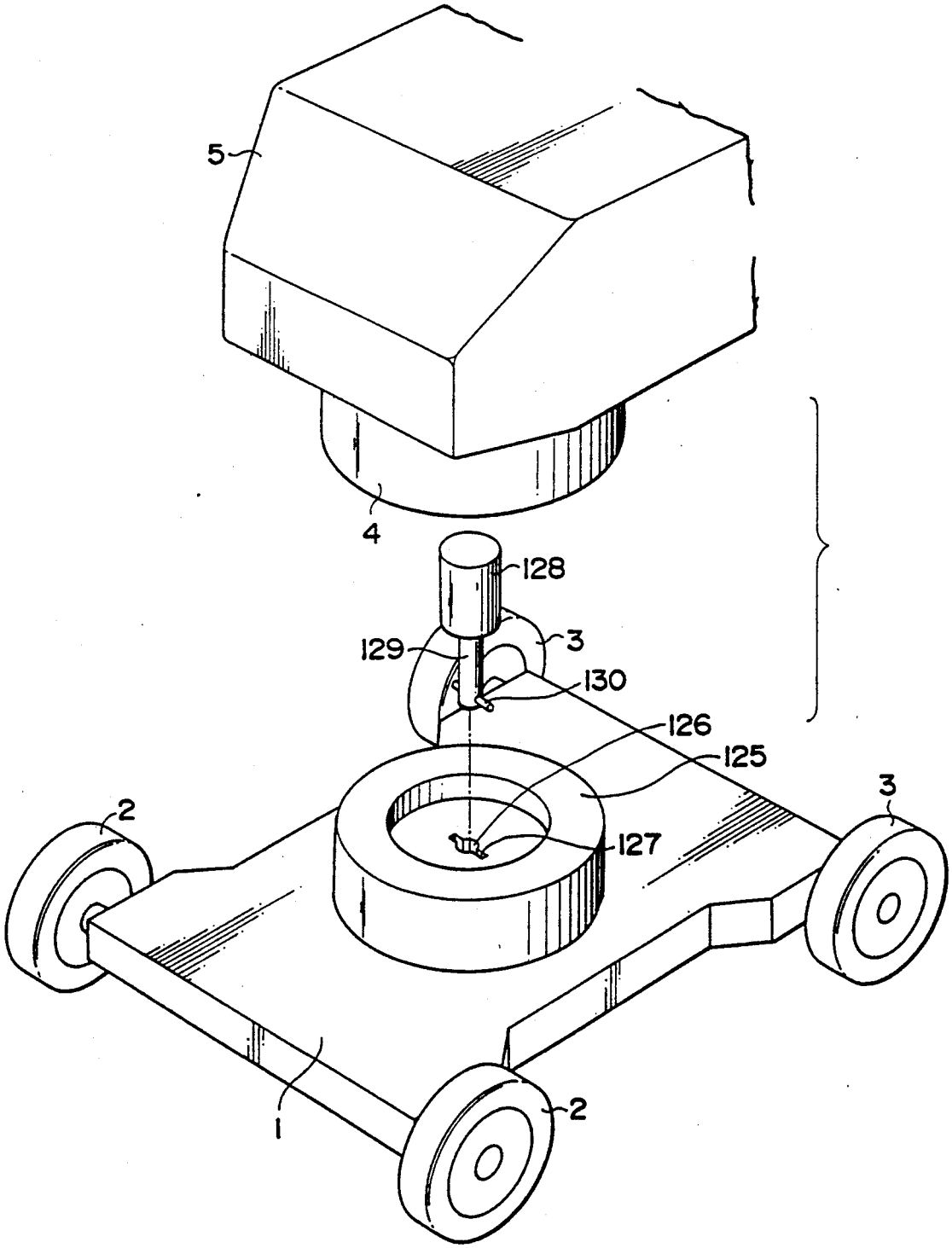
FIG. 9 is an enlarged pespective view showing a relationship between a chassis and a turntable, respectively constituents of the lifting apparatus of the second embodiment.

The turning shaft 125 on the chassis is described more in detail with reference to FIG. 9.

The turning shaft 125 for holding the turntable 5 protrudes in ring shaped and has a detection hole 126 defined by a vertical opening in the central portion thereof. A groove 127 is defined inside the detection hole 126 for effecting synchronization between the rotary panels 122 and 123 and the turntable 5. There is fixed inside the skirt 4 a rotary encoder 128 which is rotatable together with the turntable 5 and detects the horizontal rotary angle relative to the chassis 1. A detection shaft 129 rotatably protrudes from the rotary encolder 128 and is inserted into the detection hole 126 while a pin 130 protrudes from both sides of the detection shaft 129 and is engaged in the groove 127 to prevent relative rotation between the detection hole 126 and the detection shaft 129.

Figure 10:
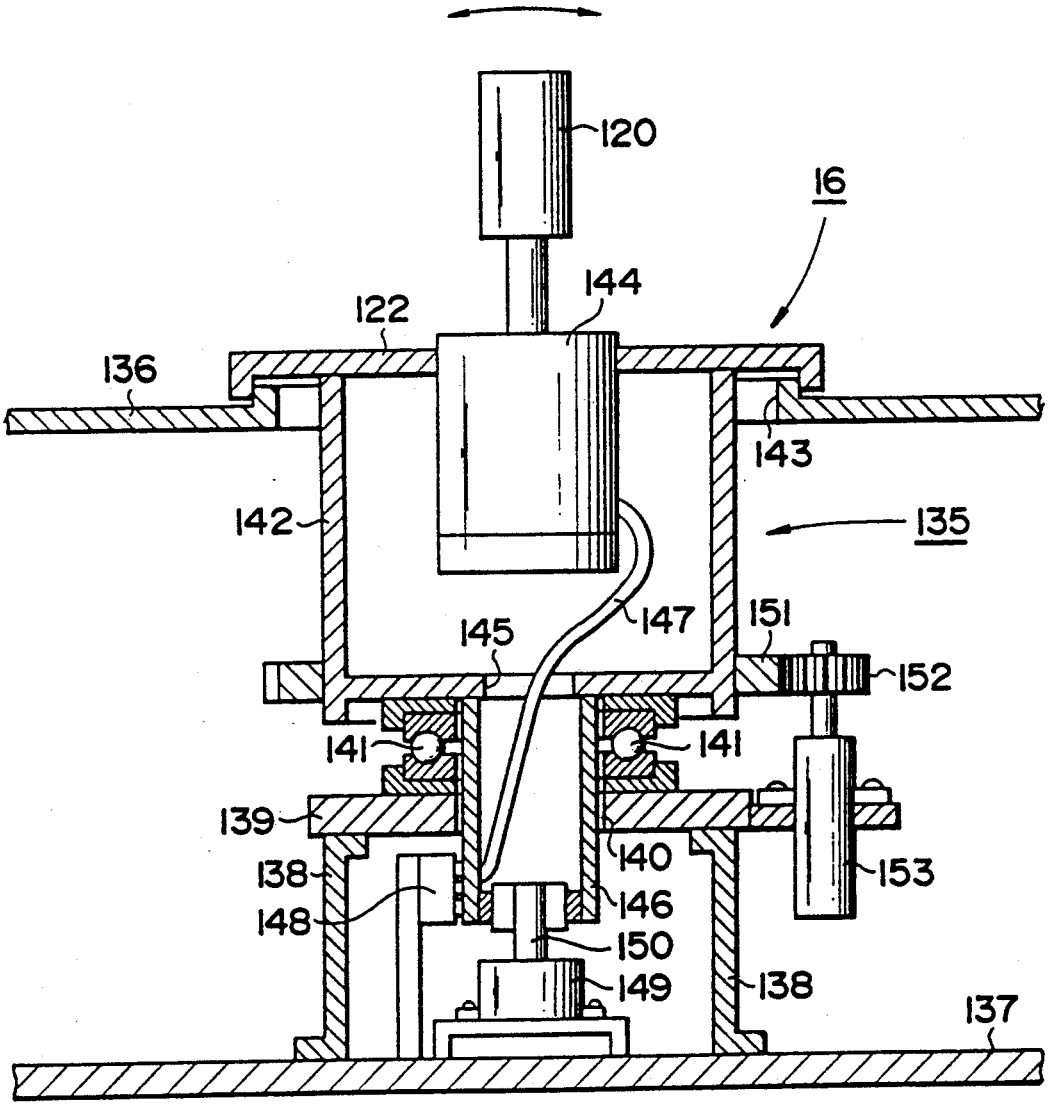
FIG. 10 is a cross sectional view showing a synchronous mechanism employed by the lifting apparatus of the second embodiment.

The synchronous mechanism 135 provided inside the operation mechanism 16 will be described more in detail with reference to FIG. 10.

The synchronous mechanism 135 of the driving lever 120 and the rotary panel 122 is explained hereinafter. However, the explanation of the arrangement of the synchronous mechanism of the steering lever 121 and the rotary panel 123 will be omitted since the arrangement of the synchronous mechanism of the driving lever 120 is the same as that of the steering lever 121.

A middle housing panel 137 is provided in parallel with but under the top or cover panel 136, and two holding legs 138 are fixed to the upper surface of the middle panel 137 at a given interval. An intermediate plate 139 is fixedly placed on the upper surfaces of the holding legs 138 and positioned between the cover panel 136 and the middle panel 137. A circular opening 140 is defined at a central portion of the intermediate plate 139 and a bearing 141 is provided around the opening 140. A substantially cup shaped holding body 142 is rotatably placed on the upper surface of the bearing 141. The upper end of the holding body 142 protrudes through an opening 143 defined in the cover panel 136, and the rotary panel 122 is fixed to the upper end of the body 142. The opening 143 is closed by the rotary panel 122 to prevent rain or wind from entering the operation mechanism 16.

The rotary panel 122 has a switch 144 fixed thereto from which switch 144 the driving lever 120 protrudes. The holding body 142 has an opening 145 at the central bottom thereof and a cylindrical body 146 is connected to the bottom of the opening 145 by way of the bearing 141 and the hole 140 so that the cylindrical body 146 may rotate together with the holding body 142. A slip ring is provided at the side of the cylinderical body 146. The slip ring is electrically connected with the switch 144 by a cable 147. An electric force collector 148 contacts the outer circumference of the slip ring. A rotary encoder 149 is fixedly provided between the two holding legs 138 and has a detection shaft 150 engaged with the lower portion of the cyrindrical body 146. A gear 151 having a large diameter is fixed to a lower circumference of the holding body 142 and meshes with a gear 152 having a small diameter at the outer circumference thereof. The gear 152 can be driven by a stepper motor 153 fixed to an intermediate plate 139.

Figure 11:
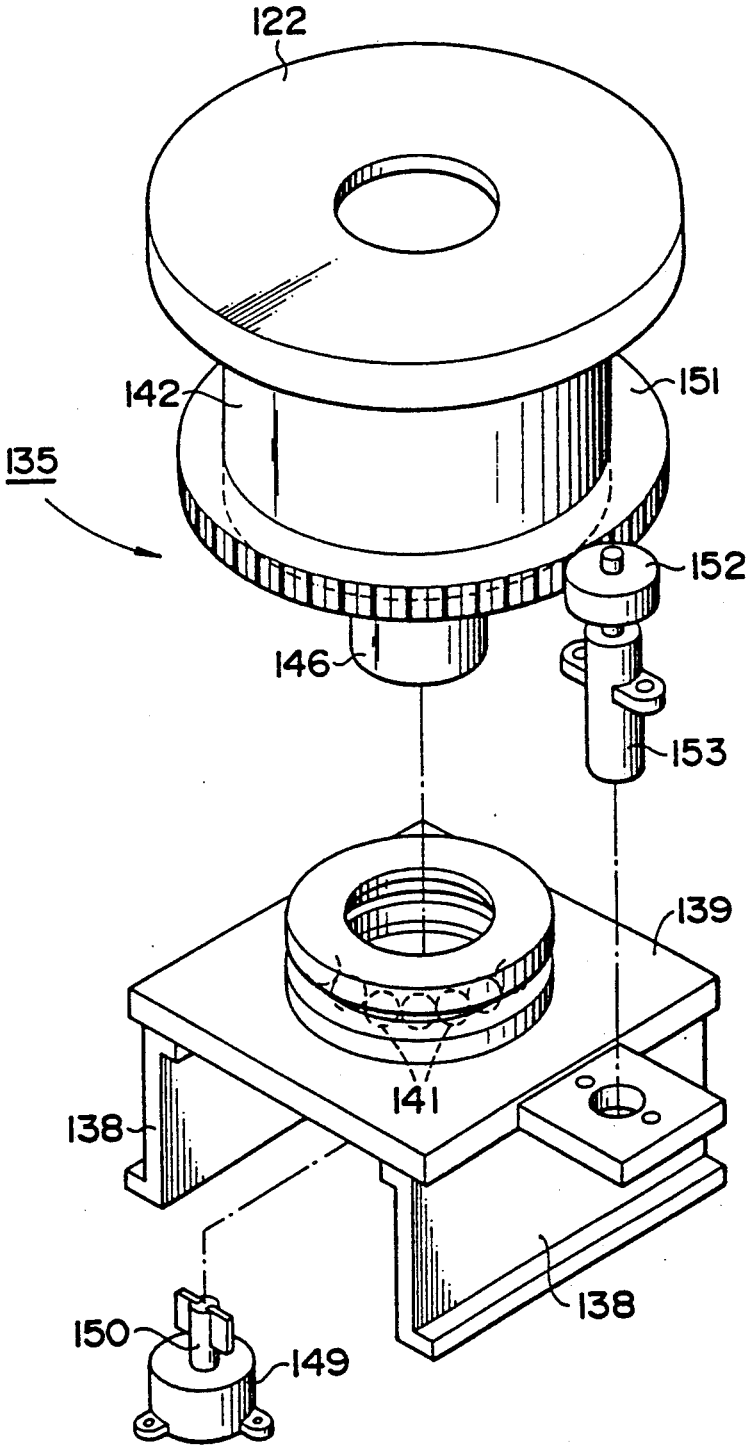
FIG. 11 is an exploded perspective view of FIG. 10, in which a part of the synchronous mechanism in FIG. 10 is omitted.

A principle portion of the synchronous mechanism 135 is illustrated in FIG. 11.

Figure 12:
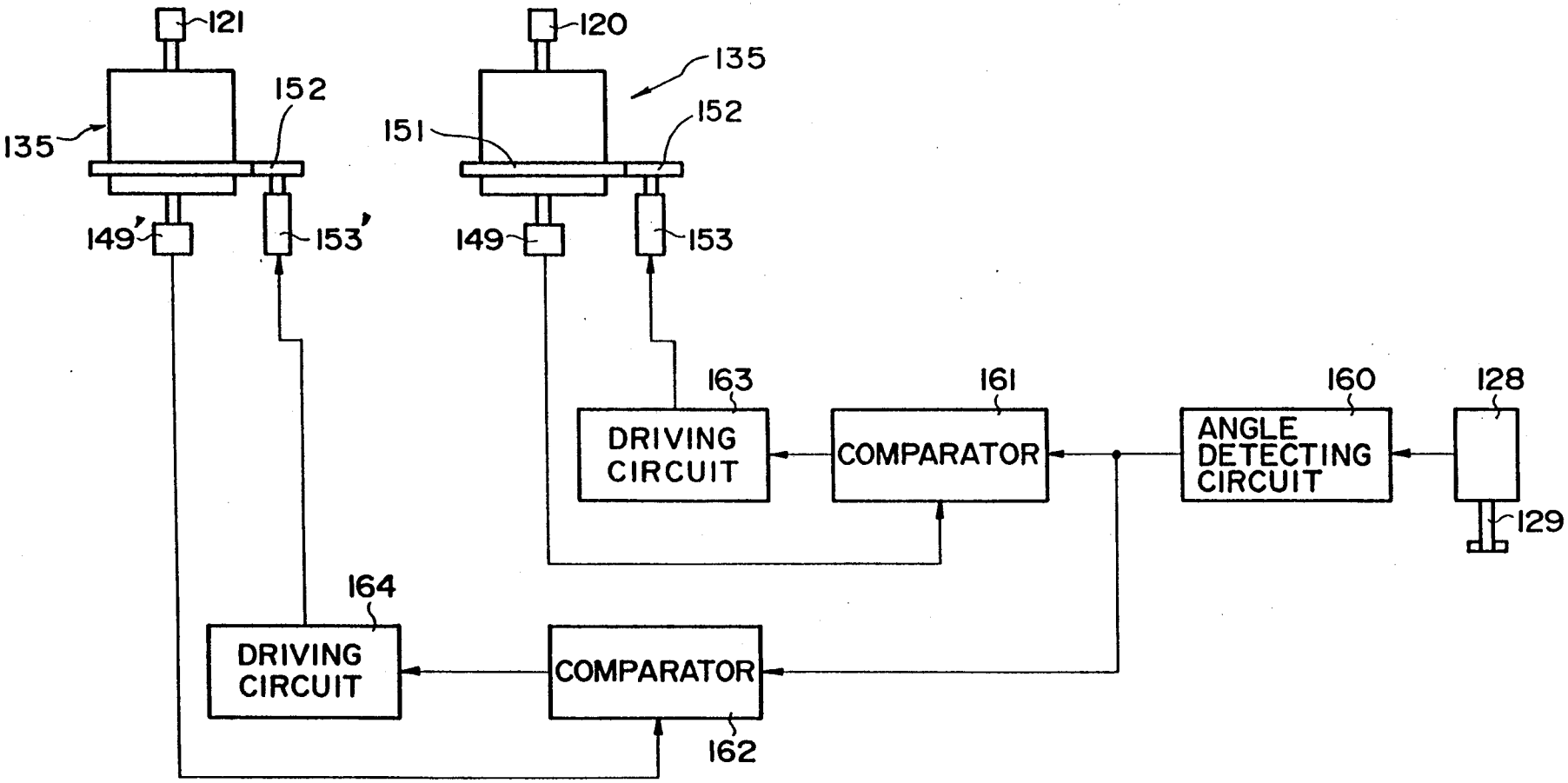
FIG. 12 is a block diagram showing a control system of the lifting apparatus of the second embodiment.

A control circuit for driving the synchronous mechanism 135 will be described with reference to FIG. 12.

An output of the rotary encoder 128 is supplied to an angle detector 160 which electrically converts the output of the rotary encoder 128 into an angle signal which is supplied to each comparator 161 and 162. Outputs of the comparators 161 and 162 are supplied to drivers 163 and 164 respectively. An output of the driver 163 is supplied to a stepper motor 153 of the synchronous mechanism 135. An output of the driver 164 is supplied to a stepper motor 153' for driving a synchronous mechanism 135' of the steering lever 121. An output of the rotary encoder 149 provided at the synchronous mechanism 135 of the driving lever 120 is supplied to the comparator 161 as a correction signal. An output of the rotary encoder 149' provided at the synchronous mechanism 135 of the steering lever 121 is supplied to the comparator 162 as a correction signal.

An operation of the operation control mechanism according to the second embodiment of the present invention will be described hereinafter with reference to FIG. 13 which exemplifies the case where the turntable 5 is horizontally turned clockwise 360° about the chassis 1.

When the turntable 5 is turned relative to the chassis 1, the detection shaft 129 is rotated relative to the turntable 5 since the detection shaft 129 is connected to the chassis 1 so that the rotary encoder 128 fixed to the turntable 5 detects the rotary angle. The output detected by the rotary encoder 128 is supplied to the angle detector 160. The angle detector 160 judges the rotary angle, i.e. an angular interval between the turntable and the chassis which stays at the position (J) in FIG. 13 and provides a turning angle signal as a control signal which is supplied to the comparator 161 and 162. The comparators 161 and 162 supply the turning angle signal to the drivers 163 and 164 for driving the stepper motors 153 and 153'. The rotary motions of the stepper motors 153 and 153' are transmitted to the gears 152. The gears 151 having the large diameter meshing with the gears 152 are rotated when the gears 152 are rotated. Since the gears 151 and the holding bodies 142 are supported by the bearings 141, the gears 151, the holding bodies 142, the cyrindrical bodies 146 and the rotary panels 122 and 123 are rotated at the same time. At the time when the holding body 142 is rotated, the stepper motor 149 and 149' connected to the respective cylindrical body 146 detects the rotary angle and supplies it to the respective comparator 161 and 162 as a feedback signal. Accordingly, the stepper motors 153 and 153' are driven for the angle corresponding to the angular interval between the turntable and the chassis. Hence, the rotary angle of the holding body 142, the cylindrical body 146, and the rotary panels 122 and 123 accords with the angular interval between the turntable 5 and the chassis 1.

Figure 13:
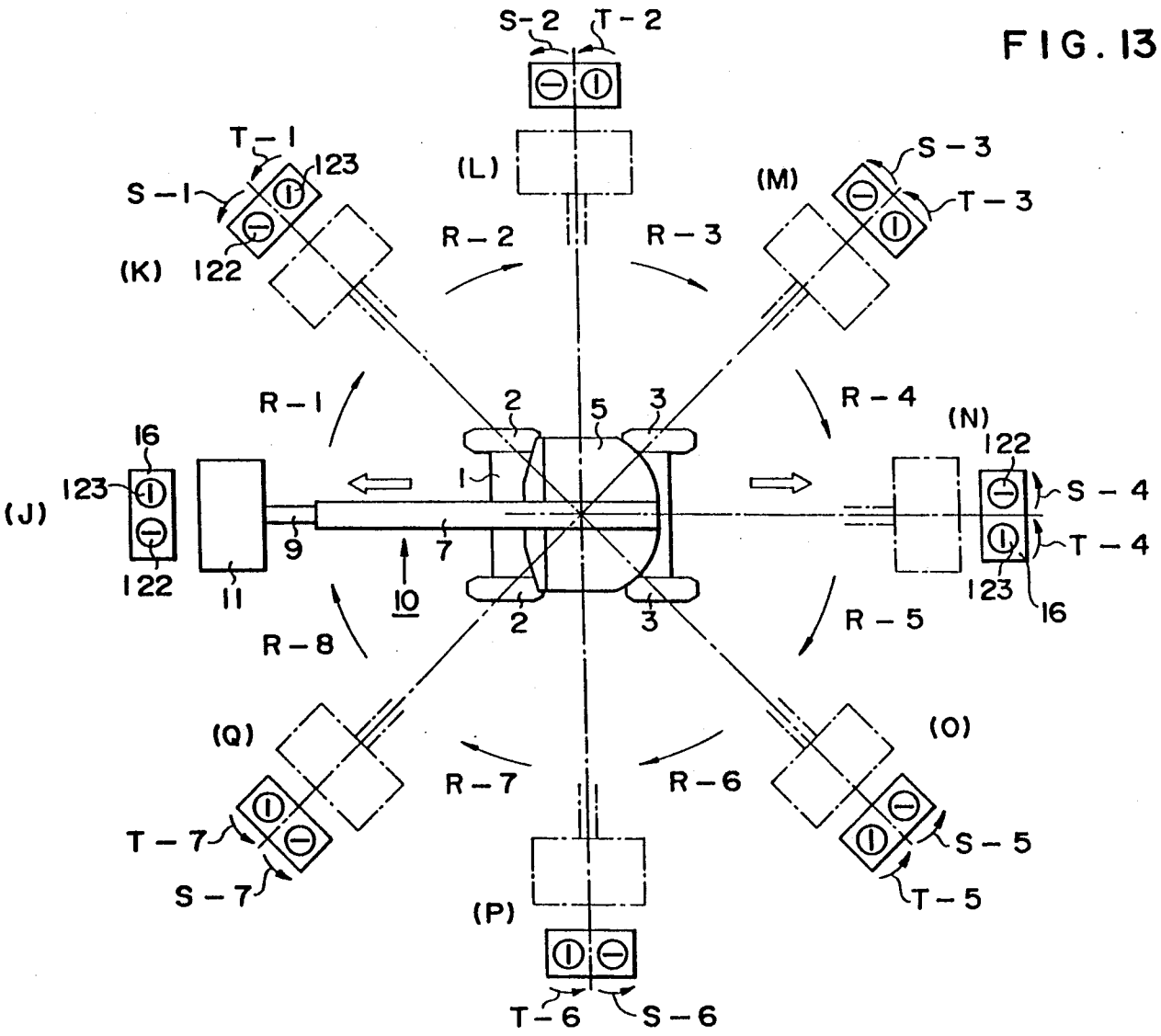
FIG. 13 is a view showing the operation of the synchronous mechanism of the second embodiment.

In the state where the turntable is turned 45° in the direction of R-1 as illustrated at (K) in FIG. 13, the rotary panels 122 and 123 each turn 45° in the directions of S-1 and T-1 respectively. Accordingly, the operation directions of the driving lever 120 provided at the rotary panel 122 are kept in parallel with front and rear directions of the chassis 1. Furthermore, the steering lever 121 provided at the rotary panel 123 rotates to be right angled relative to the front and rear directions of the chassis 1. Accordingly, the chassis 1 moves forward or backward in the direction where the driving lever 120 is respectivley pushed away from or pulled toward the operator. When the steering lever 121 is pushed rightward or leftward at the rotary panel 123, the chassis 1 can be turned in the direction where the steering lever 121 is pushed.

Furthermore, even if the turntable 5 is turned 360° in the direction of R-2, R-3, R-4, R-5, R-6, R-7 and R-8, the rotary panels 122, 123 rotate in the directions of S-2, T-2, S-3, T-3 . . . . following the turning of the turntable 5 so that the directions where the driving lever 120 and the steering lever 121 are pushed are always respectively kept parallel with and at a right angle relative to the chassis 1 front/rear movement direction.

Particularly, in the case where the operation mechanism 16 is turned 180°, i.e. in opposite direction relative to the chassis 1 at the position denoted (N) in FIG. 7, the rotary panel 122 is also turned 180° so that the direction where the driving lever 120 is pushed is also turned 180°.

Accordingly, if the driving lever 120 is pushed forward at the state denoted at (N) in FIG. 13 where the turntable is positioned in opposite direction relative to the normal front of the chassis 1, the chassis 1 travels backward (rightward in FIG. 13) whereby the direction where the driving lever 120 is pushed completely accords with the travel direction of the chassis 1.

Consequently, the driving and steering levers provided at the operation mechanism 16 follow so as to be operated in the same direction as the direction where the bucket 11 is directed. As a result, the drivers feeling is kept constant irrespective of the position of the turntable 5 relative to the chassis 1.

With the arrangement of the operation control mechanism, the operation control mechanism is always directed in the same direction even if the turntable is turned in any direction relative to the chassis so that the chassis can travel or turned in the direction where the driving lever or the steering lever is pushed.

Accordingly, the operator is free from the judgement of the direction to control the operation mechanism. The operator need not consider the direction of turning of the turntable relative to the chassis and does not feel any malaise. As a result, the operator does not erroneously operate the lifting apparatus, namely, wrongly pushes the driving lever at the time when the bucket approaches a beam or building. It is therefore possible to prevent the operator from being involved in the accident resulting in injury or death.

Although the invention has been described in its preferred form with a certain degree of particularity, it is to be understood that many variations and changes are possible in the invention without departing from the scope thereof.

What is claimed is:

1. A lifting apparatus comprising:

a movable chassis having front and rear ends, and a drive unit for moving the chassis in both forward and rearward directions;

a turntable mounted on the chassis for horizontal turning movement through a large angular extent, the turntable being horizontally turnable at least between front and rear positions which are horizontally spaced about 180° apart;

an extendible and elevatable boom assembly mounted on the turnable for horizontal turning movement therewith relative to the chassis, the boom assembly extending toward the front and rear ends of the chassis when the turntable is in the front and rear positions, respectively;

a bucket structure mounted on the boom assembly adjacent a free end thereof, the bucket structure being adapted to support an operator;

an operating mechanism including operator-actuated driving means mounted on the bucket structure for controlling the forward and rearward traveling direction of the chassis, said driving means being movable in opposite first and second directions relative to the boom assembly for respectively causing forward and rearward travel of the chassis when the turntable is in said front position, and reversing means for reversing the controlling direction of the driving means when the turntable is in said rear position so that movement of the driving means in said first and second directions relative to the boom assembly respectively causes backward and forward travel of the chassis.

2. An apparatus according to claim 1, wherein the reversing means includes detector means for detecting the angular position of the turntable, and control means responsive to the detector means for reversing the output rotation of the drive unit.

3. An apparatus according to claim 2, wherein the detector means includes cam means on the chassis and cooperating with a position sensor mounted on the turntable for activiting the control means.

4. An apparatus according to claim 2, including means for disabling the drive unit when the boom assembly projects sidewardly of the chassis for preventing traveling movement of the chassis.

5. An apparatus according to claim 1, wherein said reversing means includes support means mounting said driving means for substantially horizontal rotation relative to the bucket structure, and control means for rotating the support means in correspondence to the horizontal angular movement of the turntable.

6. An apparatus according to claim 5, wherein the control means includes a synchronized drive for horizontally angularly turning the support means in synchronization with the turning of the turntable.

7. An apparatus according to claim 6, wherein the reversing means includes position detecting means for detecting the angular position of the turntable relative to the chassis for transmitting a signal for controlling the synchronized drive.

8. An apparatus according to claim 1, wherein the driving means comprises a movably-operated lever movable from a middle position in opposite directions toward said first and second positions.

9. An operation control mechanism in a lifting apparatus comprising:

a chassis having opposite ends and being movable both forwardly and rewardly;

a turntable rotatively mounted on the chassis and capable of horizontally turning through substantially a full revolution relative to the chassis;

a boom assembly mounted on the turntable for horizontal turning movement therewith relative to the chasis;

a bucket connected to a top end of the boom assembly and adapted to confine an operator; and an operation mechanism provided on the bucket and including (a) detection means for detecting the horizontal angular position of the turntable relative to the chassis, (b) driving means for controlling a traveling direction of the chassis, (c) steering means for controlling the turning direction of the chassis, and (d) inversing means for inverting the controlling direction of both the driving means and the steering means relative to the boom assembly so that both the driving means and the steering means are movable in the same direction relative to the intended travel direction of the chassis when the boom assembly is directed toward either end of the chassis.

10. An operation control mechanism in a lifting apparatus comprising:

a movable chassis;

a turntable rotatively mounted on the chassis and capable of horizontally turning through substantially a full revolution relative to the chassis;

a boom assembly mounted on the turntable for horizontal turning movement therewith relative to the chassis;

a bucket connected to a top end of the upper boom assembly for confining an operator; and an operation mechanism provided on the bucket and including (a) detection means for detecting the horizontal angular position of the turntable relative to the chassis and issuing signal in response to the angular position, (b) driving means for controlling the traveling direction of the chassis, (c) steering means for controlling the turning direction of the chassis, (d) rotary holding means for permitting the driving means and the steering means to horizontally turn relative to the boom assembly, and (e) position correction means for receiving the signal from the detection means and driving the rotary holding means so that both the driving means and steering means are not horizontally turned relative to the chassis irrespective of the angular position of the turntable.

* * * * *